US006766659B1

(12) United States Patent
Varga

(10) Patent No.: US 6,766,659 B1
(45) Date of Patent: Jul. 27, 2004

(54) MESH JEWEL AND METHOD FOR MANUFACTURING THEREOF

(76) Inventor: Miklós Varga, Marcell U. 48, H-1161 Budapest (HU)

( * ) Notice: Subject to any disclaimer, the term of this patent is extended or adjusted under 35 U.S.C. 154(b) by 0 days.

(21) Appl. No.: 10/030,755

(22) PCT Filed: Apr. 28, 2000

(86) PCT No.: PCT/HU00/00037

§ 371 (c)(1),
(2), (4) Date: Sep. 4, 2002

(87) PCT Pub. No.: WO00/65949

PCT Pub. Date: Nov. 9, 2000

(30) Foreign Application Priority Data

Apr. 28, 1999 (HU) ..... P9901406
Oct. 6, 1999 (HU) ..... P9903394

(51) Int. Cl.[7] ..... A44C 25/00

(52) U.S. Cl. ..... 63/37; 63/15; D11/27; D11/26; D11/13

(58) Field of Search ..... 63/15, 37; D11/26, D11/27, 28, 29, 30, 31, 32, 33, 34, 35, 36, 37, 38, 39, 13; 446/26, 273, 85, 487, 119, 486, 489

(56) References Cited

U.S. PATENT DOCUMENTS 2,258,413 A * 10/1941 Koven ..... 63/31
D203,859 S * 2/1966 Anderson ..... D11/13
D225,018 S * 10/1972 Shiman ..... D11/34
3,905,133 A * 9/1975 Charman ..... 434/83
3,977,683 A * 8/1976 Tomura ..... 273/155
4,332,501 A * 6/1982 Slysh ..... 403/219
4,627,231 A * 12/1986 Kiuchi ..... 59/80
5,224,959 A * 7/1993 Kasper ..... 482/114
5,230,631 A * 7/1993 Halmaghi et al. ..... 434/284
5,918,438 A * 7/1999 South ..... 52/745.07

FOREIGN PATENT DOCUMENTS

DE 2919912 8/1980
DE 3424206 A1 1/1986
DE 4317210 A1 11/1994
EP 0495100 A1 7/1992

* cited by examiner

*Primary Examiner*—J. J. Swann
*Assistant Examiner*—Katherine Mitchell
(74) *Attorney, Agent, or Firm*—Knobbe, Martens, Olson & Bear, LLP

(57) ABSTRACT

A mesh jewel comprising a mesh formed by at least one metallic wire section (4) arranged along a mesh surface, wherein the mesh comprises nodes located at adjoining wire section parts of the at least one wire section (4). At least some of the nodes are formed with a node element (1) comprising a pin (2) arranged in cross direction to the mesh surface and structure for preventing displacement in an axial direction of the pin (2) of the wire section parts adjoining the pin (2) of the node element (1). The inventive method for manufacturing the mesh jewel comprises the steps of forming a mesh with at least one metallic wire section (4) by arranging it along a mesh surface, wherein the mesh comprises nodes at adjoining wire section parts of the at least one wire section (4). According to the invention, pins (2) are arranged in cross direction to the mesh surface, and the at least one wire section (4) is arranged so as to pass by the pins (2) and ends of the at least one wire section (4) are attached to the mesh jewel, wherein the pins (2) are fitted with structure for preventing displacement in an axial direction of the pins (2) of the wire section parts adjoining the pins (2).

15 Claims, 10 Drawing Sheets

MESH JEWEL AND METHOD FOR MANUFACTURING THEREOF

TECHNICAL FIELD

The invention relates to a mesh jewel and a method for manufacturing thereof.

BACKGROUND ART

For producing jewels, high purity precious metals, for example platinum, gold or silver are generally used. High purity precious metals have a very high specific weight and they are very expensive, consequently large size jewels made of these metals are relatively heavy and expensive. Heavy jewels cause discomfort to people wearing them, and the high price does not allow a broader distribution of these jewels. In addition, it is a known fact that relatively thick pure precious metal pieces are difficult to machine, i.e. that they are difficult to cut, bend and draw.

A known solution for eliminating these problems in the jewel industry is the producing of so called mesh jewels, which comprise a mesh made of precious metal wire, arranged in a plane or along a three dimensional surface. This mesh enables the manufacturing of large size, attractive and yet low weight and not too expensive jewels.

A mesh jewel and a method for its manufacturing are described for example in EP 0 495 100 A1. This known mesh jewel comprises a precious metal mesh arranged in a plane and fitted in a precious metal setting. The precious metal mesh is produced by laying at random a large number of metal wires bent in different shapes, followed by pressing, and then the metal wires are fixed to each other at the nodes. This fixing can be for example a diffusion joint assisted by heat treatment. Next, the mesh is subjected to cold working, polishing and then it is placed into the setting. This known method is primarily suitable for producing meshes arranged in a plane, and the mesh may not have a complicated three dimensional shape. In the case of a larger surface mesh, another problem arises, namely that the mesh will not be sufficiently rigid and in the course of use the mesh jewel is subjected to a permanent deformation. Furthermore, this known method does not enable the fitting of decorative elements along the surface of the mesh.

Another solution known to the jewel industry is when—by the manual arrangement of the precious metal wire—a three dimensional mesh surface is formed, and the wire nodes are soldered or welded one by one. This solution, however, does not allow the accomplishing of sufficient rigidity in the case of larger size jewels, and it is very difficult to fit decorative elements along the three dimensional surface.

A further mesh jewel and a method for its manufacture are described in DE 29 19 912 A. This mesh jewel comprises node elements at crossings of the metal wire sections forming the mesh. The node elements are formed as balls having two through bores arranged in crosswise direction to each other through which the wire sections are inserted. These node elements are, however, difficult and costly to manufacture, and do not allow the crossing of more than two wire sections at a node. Furthermore, there is no teaching in DE 29 19 912 A about fixing these node elements in space. Therefore, this known mesh jewel can not be manufactured with a dense mesh and with a sufficient rigidity.

DISCLOSURE OF INVENTION

It is an object of the invention to provide a mesh jewel which—with a relatively low weight—has sufficient rigidity even in the case of larger dimensions to prevent permanent deformation even during prolonged use, and which enables the fitting of decorative elements along the mesh of the mesh jewel. It is another object of the invention to provide a simple and cost-efficient method for manufacturing the mesh jewel.

According to a first aspect, the invention is a mesh jewel comprising a mesh formed by at least one metallic wire section arranged along a mesh surface, wherein the mesh comprises nodes located at adjoining wire section parts of said at least one wire section, and wherein at least some of the nodes are formed with a node element fixing the adjoining wire section parts together. According to the invention, the mesh jewel has node elements comprising a pin arranged in cross direction to the mesh surface, wherein the wire section parts adjoining the pin are tangential to or bent on the pin, and wherein ends of the pin are closed by retaining means so as to prevent displacement of the adjoining wire section parts in an axial direction of the pin, said retaining means comprising a retaining element arranged at an end of the pin.

The inventive mesh with the node elements results in a higher rigidity mesh jewel, which enables the manufacturing of larger and thus more decorative jewels with a low total weight. In addition, the higher rigidity further reduces the risk of permanent deformation when the jewel is in use. Furthermore, the node elements—by themselves or with decorative elements fixed to them—are suitable for creating a more attractive jewel.

In a particularly preferred embodiment, the retaining element can be formed for example as a flange, a ball having a bore, a setting holding a gem, or a soldered, welded, bonded or adhesive closing. The retaining elements can be fitted onto the end of the pin and fixed to the pin by soldering or welding, but they can be is formed integrally with the pin as well.

The mesh can be made more rigid, if the wire section parts adjoining the pins of the node elements are fixed to the node elements by soldering or welding. The at least one wire section is tangential to or bent on the pins of the node elements, and passes by the pins at least twice from different directions.

The mesh surface can be planar, a three-dimensional curved surface or a three-dimensional surface defined by planes.

In another preferred embodiment, the mesh jewel comprises a latticework formed along the mesh surface, wherein the at least one wire section is arranged along a surface of the latticework and is attached to node elements fixed to lattice knots of the latticework. In this embodiment the latticework ensures the spatial fixing of the node elements. The fixing of the node elements is very important because in this way the wire section can be tightened on the pins of the node elements, thereby providing a more rigid structure. In this way, the latticework according to the invention allows the producing of a more rigid mesh jewel, which is larger and thus more decorative, with a low total weight. The higher rigidity also reduces the risk of the jewel suffering a permanent deformation while being worn.

In a further preferred embodiment the mesh jewel comprises a rigid jewel body to which the mesh is attached by means of through holes or fixing node elements secured to the jewel body. In this case the node elements can be fixed to the jewel body by means of distance rods, thereby resulting in a more rigid jewel.

Parts of or the entire mesh jewel can be preferably formed integrally by casting. The material of the inventive mesh jewel can be platinum, gold, silver, titanium and/or stainless steel.

According to a second aspect, the invention is a method for manufacturing a mesh jewel, comprising the steps of forming a mesh with at least one metallic wire section by arranging it along a mesh surface, wherein the mesh comprises nodes at adjoining wire section parts of said at least one wire section, and wherein at least some of the nodes are formed with a node element fixing the adjoining wire section parts together, characterised by arranging pins in cross direction to the mesh surface, and arranging said at least one wire section so as to pass tangentially to or bent on the pins and attaching ends of said at least one wire section to the mesh jewel, wherein ends of the pins are closed by retaining means so as to prevent displacement of adjoining wire section parts in an axial direction of the pin, said retaining means comprising retaining elements arranged at the ends of the pins.

By means of the method according to the invention, a mesh jewel with a higher rigidity can be manufactured simply and with a relatively low cost. The inventive method enables simple fitting of decorative elements along the surface of the mesh.

For forming the mesh, preferably a shaping piece having a surface corresponding to the mesh surface can be used. The shaping piece can be placed onto a rigid jewel body, and the at least one wire section can be arranged fixedly attached to the jewel body. The shaping piece is preferably made of a material completely removable by heat treating or by applying a solvent.

By means of the shaping piece, on the one hand the wire section can be guided in a way that it is adjusted to the surface of the shaping piece, and on the other the node elements are thereby spatially fixed. Fixing the node elements is very important because in this way the wire section can be tightened on the pins of the node elements, thereby ensuring a more rigid structure.

BRIEF DESCRIPTION OF DRAWINGS

Hereinafter, the invention will be described by means of preferred embodiments as shown in the drawings, where.

MODES FOR CARRYING OUT THE INVENTION

Figure 1:
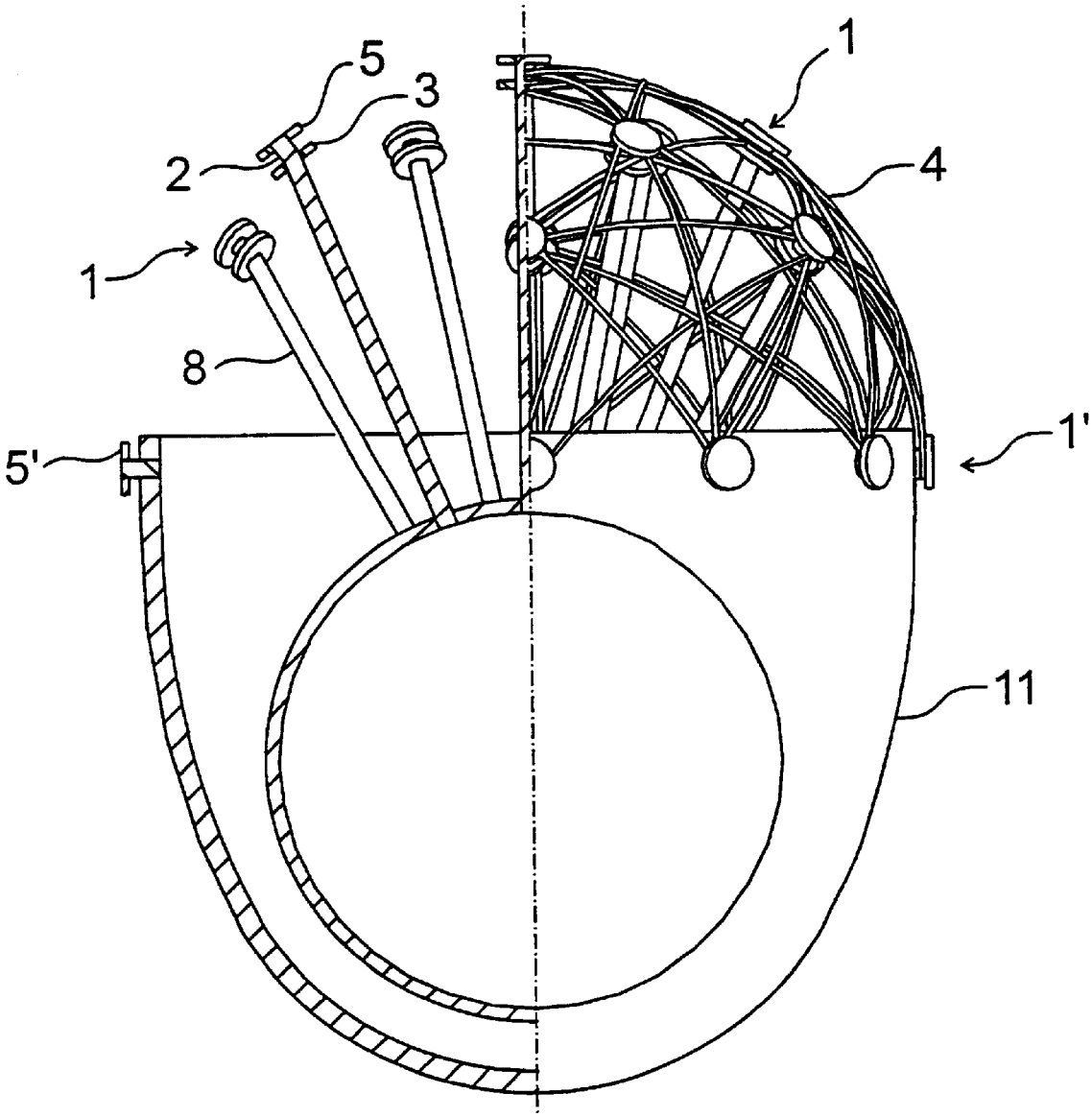
FIG. 1 is a front view of a preferred embodiment of a mesh jewel according to the invention partly in cross-section.
Figure 2:
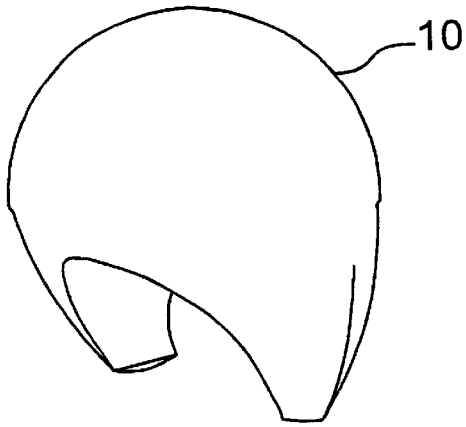
FIGS. 2 to 4 are schematical drawings depicting manufacturing steps of the embodiment as shown in FIG. 1.
Figure 3:
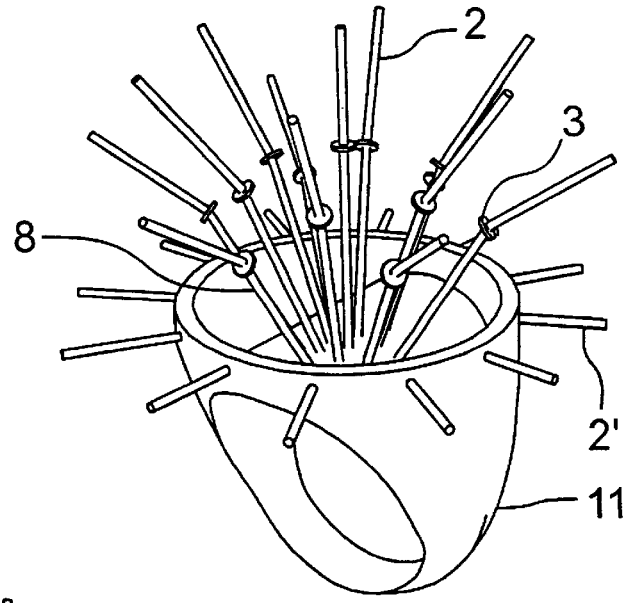

The mesh jewel depicted in FIG. 1 is a ring which comprises a mesh made of one or more wire sections 4, and a rigid jewel body 11, to which the mesh is fixed. Nodes of the mesh are formed with node elements 1 arranged along a spherical surface, which node elements 1 comprise a pin 2 arranged crosswise to the spherical surface, a retaining element 3 arranged at an inner end of the pin 2, and a retaining element 5 arranged at an outer end of the pin 2. In the depicted embodiment, the retaining elements 3 and 5 are flanges, which are pulled on the ends of the pin and fixed there by welding or soldering. These flanges ensure that wire section parts passing by the node elements 1 are prevented in displacement in an axial direction of pin 2, thereby enabling the design of a rigid mesh. Node elements 1 are secured to the jewel body 11 by means of distance rods 8 in a way that the distance rods 8 are fitted into bores in jewel body 11, and fixed there by welding or soldering. The distance rods 8 serve as a firm support for the node elements 1, thereby increasing the rigidity of the mesh jewel. The distance rods 8 are not necessarily placed into bores, but they can also be welded or soldered to the wall of the jewel body 11.

On an external lateral surface of an upper flange part of the jewel body 11 there are fixing node elements 1' uniformly distributed in a circle, and they fix the mesh to the jewel body 11. Fixing pins 2' of the fixing node elements 1' are located in bores of jewel body 11, and fixed there by welding or soldering. The fixing node elements 1' comprise a retaining element 5' arranged at an outer end of the fixing pins 2', which retaining element is formed as a flange in the embodiment shown. This flange prevents the wire section parts adjoining the fixing pins 2' in coming off the retaining pin 2'. It is not necessary to locate the fixing pins 2' in bores, but they can also be welded or soldered to the wall of jewel body 11.

As it will be shown more detailed later on, the wire section 4 is arranged on the pins 2 of the node elements 1 located along the spherical surface in a manner that it touches the pins 2 without changing direction or is bent on them, and it returns to the pins 2 repeatedly from different directions, so that the pins 2 are surrounded by wire section 4. Parts of the wire section 4 touching the pins 2 and 2' may be fixed by laser spot welding or soldering to respective node elements 1 and 1'.

In the manufacturing method of the preferred embodiment as per FIG. 1, as shown in FIGS. 2 to 8, first a shaping piece 10 having a surface corresponding to a three dimensional mesh surface to be formed is produced. The shaping piece 10 is produced of a material that can be fully removed by heat treatment or by using a solvent, preferably wax, for example by carving or modelling. Next, elements consisting of the retaining element 3 formed as a flange and the pin 2 are secured by means of the distance rods 8 to the jewel body 11, wherein the jewel body 11 is matched in shape to the shaping piece 10. The distance rods 8 may be formed as extensions of the pins 2, but they can also be designed as separate elements, fixed to the pins 2 by welding or soldering.

Furthermore, on the external lateral surface of the upper flange part of the jewel body 11, bores located at equal spacing are formed to receive fixing pins 2', which are secured in the bores by welding or soldering.

Figure 4:
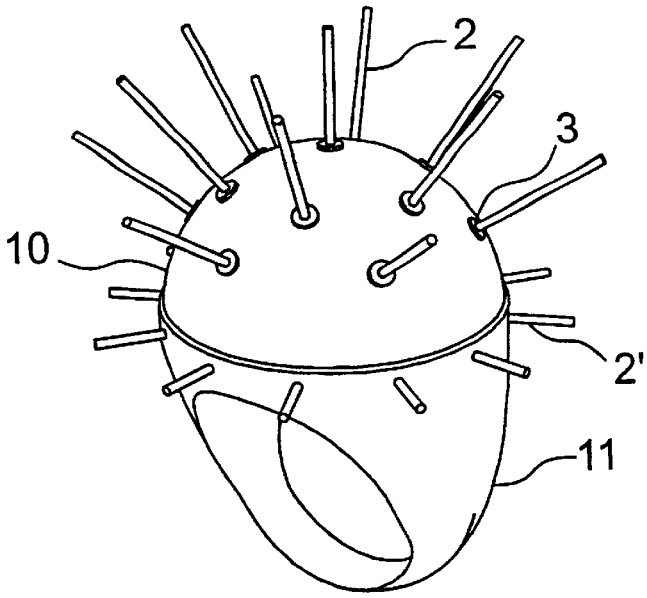

Next, the spacing structure fitted on the jewel body 11 as described above is heated up and the shaping piece 10 is pulled onto the structure. When fitting the shaping piece 10, bulges appearing on its surface are smoothed and so the interim phase shown in FIG. 4 is obtained. The shaping piece 10 fixes the pins 2 and this offers an especially advantageous hold for the spacing structure when arranging the wire section 4 and when tightening the same.

Figure 5:
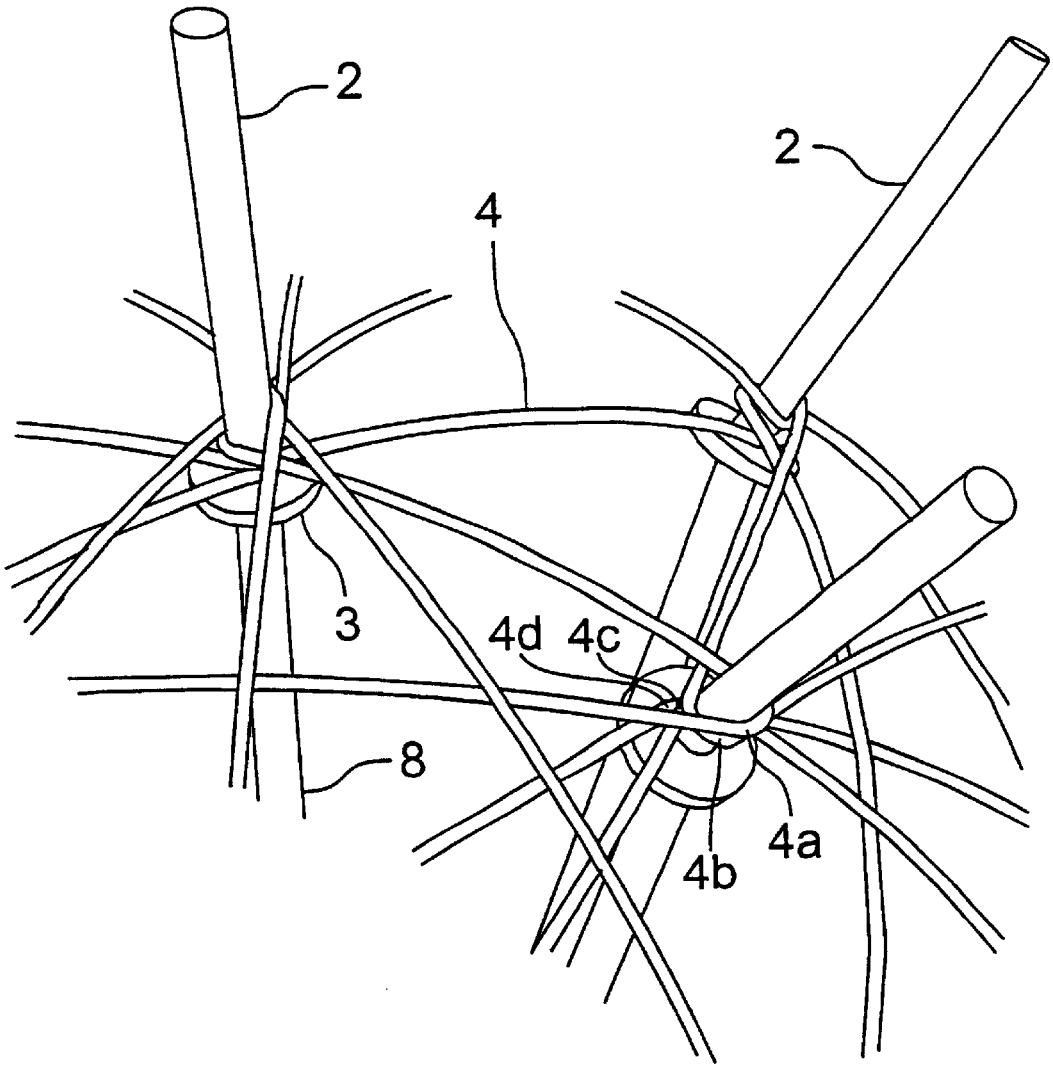
FIG. 5 is a part of the mesh of the embodiment as shown in FIG. 1, FIGS. 6 to 8 are front views depicting steps of manufacturing the node elements as shown in FIG. 1, FIGS. 9 to 11 are schematical drawings depicting manufacturing steps of another preferred embodiment of the mesh jewel according to the invention.

In the next step, by arranging the wire section 4 on the pins 2 and 2', a mesh matched to the surface of the shaping piece 10 is formed. The mesh is made of one or more wire sections 4, the thickness of which is preferably between 0.1 and 0.5 mm. Prior to forming the mesh, one end of the wire section 4 is fixed to one of the pins 2 or 2'. When making the mesh, the aesthetic appearance of the mesh jewel is to be ensured, and hence, if possible, repeated parallel running of the wire section 4 is to be avoided. Therefore, the wire section 4 is preferably guided in a zigzag shape by bending it on pins 2, 2' as depicted in FIG. 5, and then wire section 4 is repeatedly returned from different directions to the pin 2, 2' and it is thereby surrounded from several directions by the wire section 4. This guiding manner of the wire section 4 is advantageous for the aesthetic impact and also for the rigidity of the mesh jewel. The wire section 4 is tightened between the node elements 1 and 1' in a way that the wire section 4 rests on the surface of the shaping piece 10. Next, the free end of the wire section 4 is fixed to one of the node elements 1. Thereby a mesh surface following the curved surface of the shaping piece 10 is obtained. Wire section parts 4*a*, 4*b*, 4*c* and 4*d* adjoining the node elements 1 can be fixed by welding or soldering to the node elements.

Figure 6:
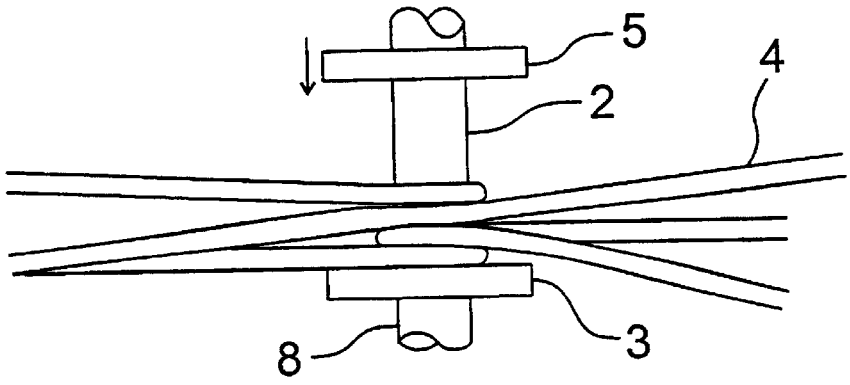
Figure 7:
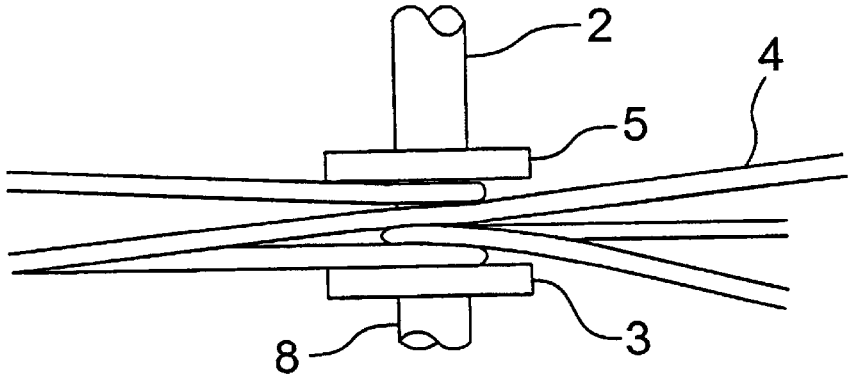
Figure 8:
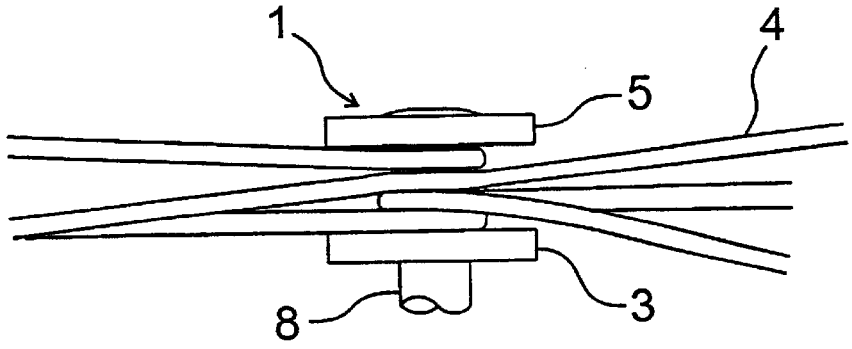

After creating the mesh, as depicted in FIGS. 6 to 8, retaining elements 5 formed as a flange are pulled onto the pins 2, protruding parts of the pins 2 are cut off, the retaining elements 5 are welded or soldered to the pins 2, and the external surface of the so formed node elements 1 is smoothed and polished. In this way, flange retaining elements 3 and 5 associated with the node elements 1 surround the wire section parts 4*a*, 4*b*, 4*c* and 4*d* bent on the pin 2. The fixing node elements 1' can be produced in an identical way with the difference that the wire section parts adjoining the pins 2' are supported by the external wall of the jewel body 11 and the by retaining elements 5'. Next, the shaping piece 10 is removed by heat treatment or by using a chemical solvent. In this way the mesh jewel shown in FIG. 1 is created.

According to the invention, instead of the fixing node elements 1', through-holes formed in the jewel body 11 can be applied as well for fixing the mesh, when during the producing of the mesh, the wire section 4 is looped by guiding it through the through-holes.

It can be advantageous that the wire section is not guided along a curved surface between the node elements, but along the shortest possible path in a straight way. In the course of manufacturing this embodiment, distance rods are fixed to the jewel body by welding or soldering, and then the spacing structure is heated up and the shaping piece made of thermoplastic material is pulled onto the spacing structure. In this embodiment, the shaping piece is necessary to be able to adjust the lengths of the distance rods according to the surface of the shaping piece, thereby arranging the node elements along the required surface. Next, the node elements are formed at the ends of the distance rods adjusted to the surface of the shaping piece or they are secured to the distance rods. Prior to making the mesh, the shaping piece is removed and then the wire section is arranged along the shortest path possible between the node elements. This embodiment is advantageous, because the wire section between the nodes is not so easily loosed, if it is guided along the shortest path possible.

Figure 9:
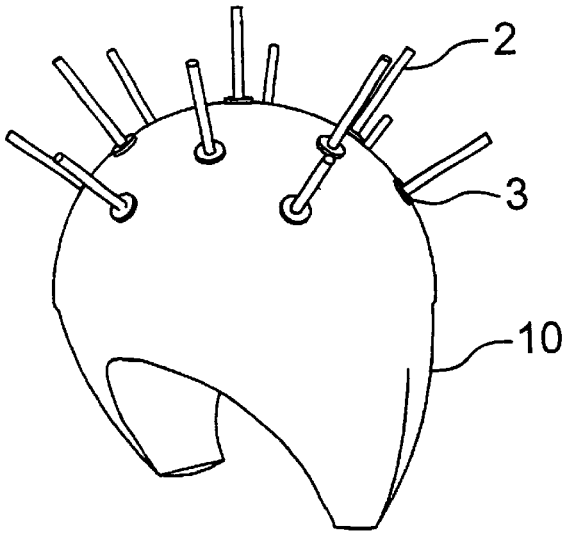
Figure 10:
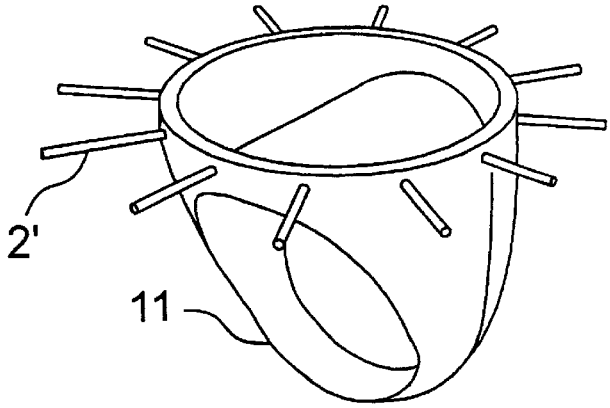
Figure 11:
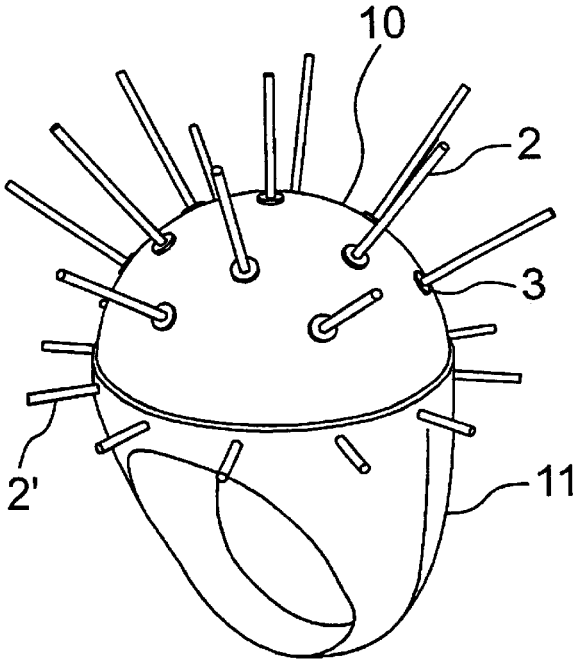

FIGS. 9 to 11 depict the steps of manufacturing a preferred embodiment of the invention, where distance rods are not used, and the node elements 1 are designed unsupported, they are only fixed by the mesh formed of wire section 4. This embodiment can be used advantageously when the mesh can be formed in a sufficiently rigid way to make sure that it is not subjected to permanent deformation even during prolonged use, and in case the mesh jewel is not subjected to any special mechanical load during use.

The manufacturing of this embodiment also starts with the forming of shaping piece 10. Next, elements comprising the retaining element 3 formed as a flange and the pin 2 are fixed to the surface of the shaping piece 10. The fixing is preferably implemented by bonding or by melting into the shaping piece 10.

Again, in a uniformly spaced way, bores are formed on the external lateral surface of the upper flange part of the jewel body 11, into which the fixing pins 2' are placed an fixed there by welding or soldering.

Next, the shaping piece 10 is placed on the jewel body 11, thereby accomplishing the interim phase depicted in FIG. 11.

In the next step, the mesh consisting of the wire section 4 is prepared as described above. After the forming of the mesh, retaining elements 5 and 5' are pulled onto the pins 2 and 2', the protruding parts of the pins 2 and 2' are cut off, the retaining elements 5 and 5' are fixed by welding or soldering to the nodes, and then the external surface of the node elements 1 and 1' are smoothed and polished. Next, the shaping piece 10 is removed as described above.

Retaining elements 3 and 5 with the pin 2 can be preferably made integrally, for example by lathe machining. In this case node elements 1 made integrally are fixed by distance rods to the jewel body or fitted on the surface of the shaping piece 10. In this embodiment, once the mesh is formed, the shaping piece can be immediately removed, because it is not necessary to close the pins. Furthermore, node elements 1 made integrally are advantageous, because a recessed setting can be formed in them for a gem on an external side of the retaining elements.

Figure 12:
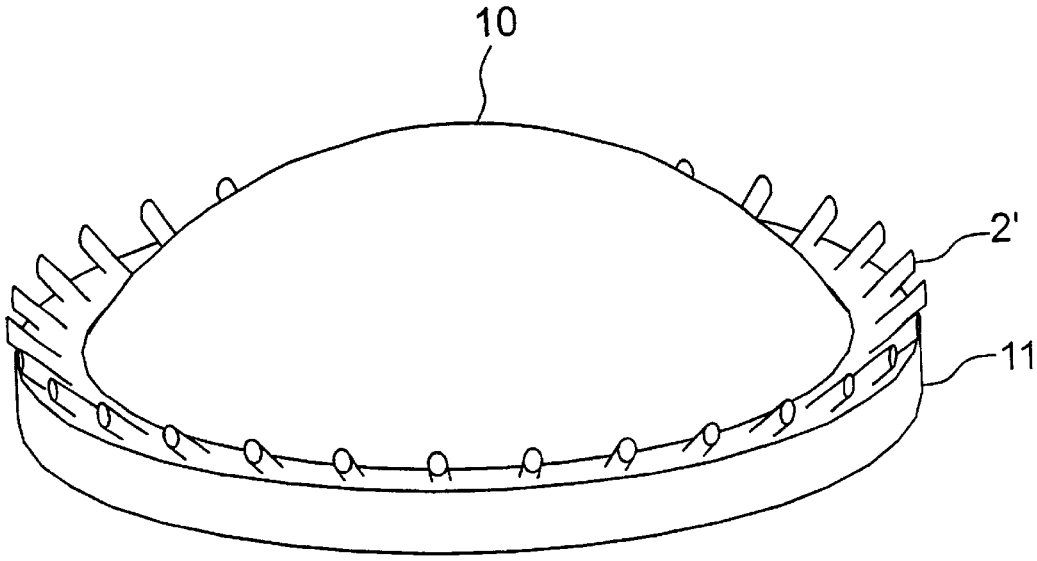
FIGS. 12 to 15 are schematical drawings depicting manufacturing steps of a further embodiment of the mesh jewel according to the invention.

Manufacturing of another preferred embodiment of the mesh jewel according to the invention begins as depicted in FIG. 12 in a way that the rigid jewel body 11 is formed as an annular frame made of solid metal. In an upper flange section of the jewel body 11, equally spaced bores are formed in which fixing pins 2' are placed and fixed by welding or soldering. Next, a shaping piece 10 having a surface corresponding to a three dimensional mesh surface to be created is placed onto the jewel body 11. In the depicted preferred embodiment, the three dimensional mesh surface is a spherical surface.

Figure 13:
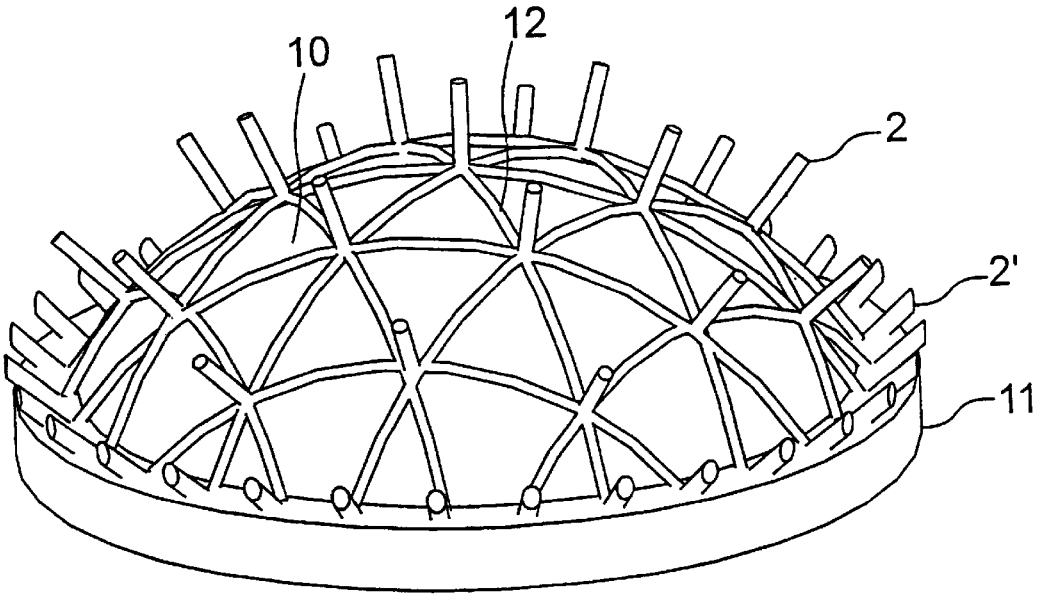

In the next step shown in FIG. 13, a latticework 12 resting on the surface of the shaping piece 10 is formed, and then in cross direction to the mesh surface, pins 2 are fixed to the lattice knots of the latticework 12.

Figure 14:
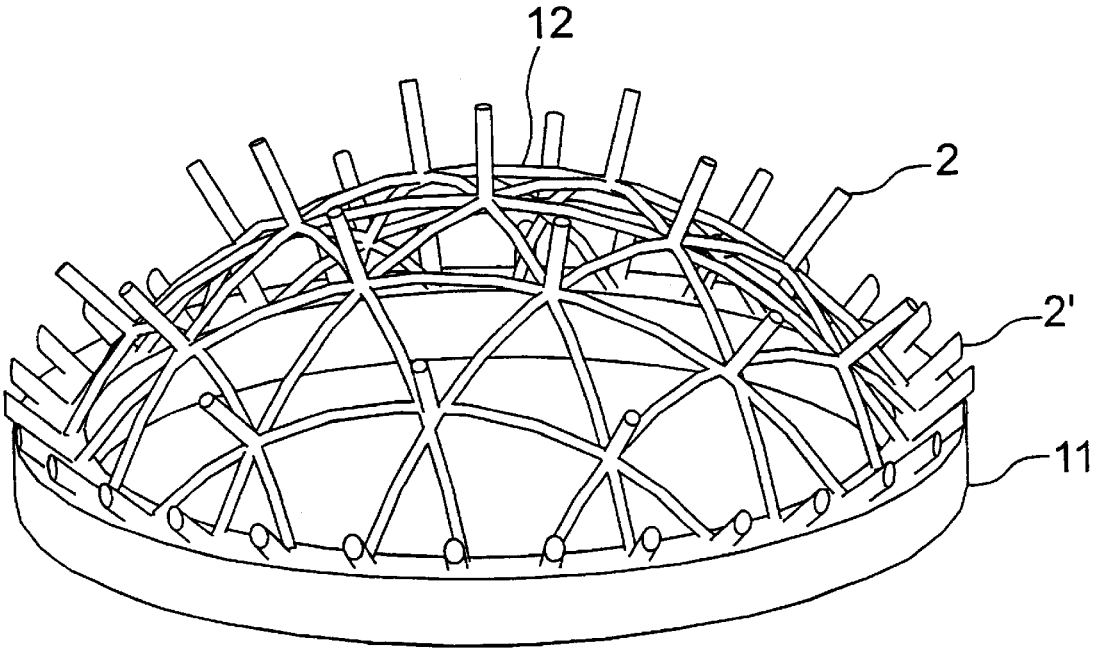

In the next step, the shaping piece 10 is removed for example by heat treatment, thereby accomplishing the skeleton structure shown in FIG. 14.

Figure 15:
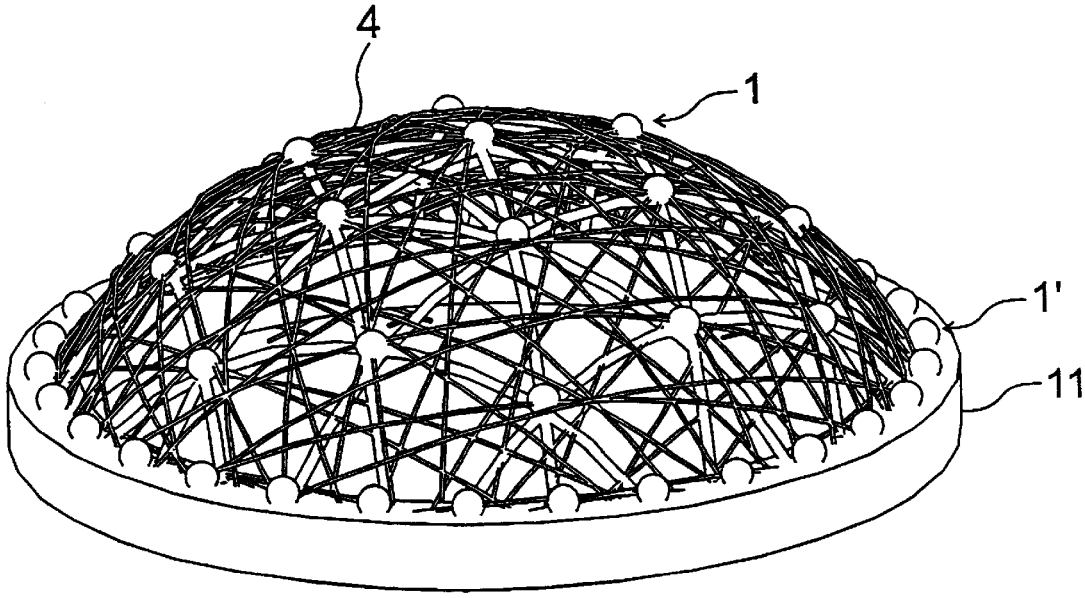

Subsequently, as shown in FIG. 15, by arranging the wire section 4 on the pins 2 and 2', a mesh arranged along the latticework 12 is formed. Between the node elements 1 and 1', the wire section 4 is tightened in a way that the wire section 4 follows the surface of the latticework 12. Thereby a mesh following the curved surface of the latticework 12 is obtained. The wire section parts passing by the node elements 1 or 1' may be fixed by welding or soldering to the node elements 1 or 1'.

After creating the mesh, protruding parts of the pins 2 and 2' are cut to size, retaining elements are pulled onto them and then the retaining elements are welded or soldered to the pins 2 and 2'. In such a way, node elements 1 and 1' are formed, where the latticework 12 and the retaining elements surround the wire section parts adjoining the pins 2 and 2'. After these steps, the mesh jewel depicted in FIG. 15 is obtained.

Deviating from the above described methods, the mesh jewel may also be manufactured by employing a casting method known per se. For example it is possible to produce the rigid jewel body 11 with the fixing pins 2' and the latticework 12 with the pins 2 integrally by casting. To this end, of course it is necessary to form a master pattern in a way described above, to produce the mould in a manner known per se. The workpiece produced by casting can then be subjected to a deburring and/or polishing method known per se, followed by the forming of the mesh on it, and the closing of the ends of the pins 2 and 2'. In the given case, the total mesh jewel, i.e. the rigid jewel body 11 with the fixing pins 2', the latticework 12 with the pins 2 and the mesh and the closings can be produced integrally by casting.

If this is required by the desired aesthetic effect, some of the openings of the latticework 12 can be covered by embossed or flat plates. The plates can be fixed by soldering or welding on the latticework 12, but they can also be produced by the above casting method. The openings can for example be covered in a chessboard pattern.

In the depicted preferred embodiment, the latticework 12 follows a pattern consisting of equilateral triangles, but it can also be designed in a square, hexagonal or random pattern.

Figure 16:
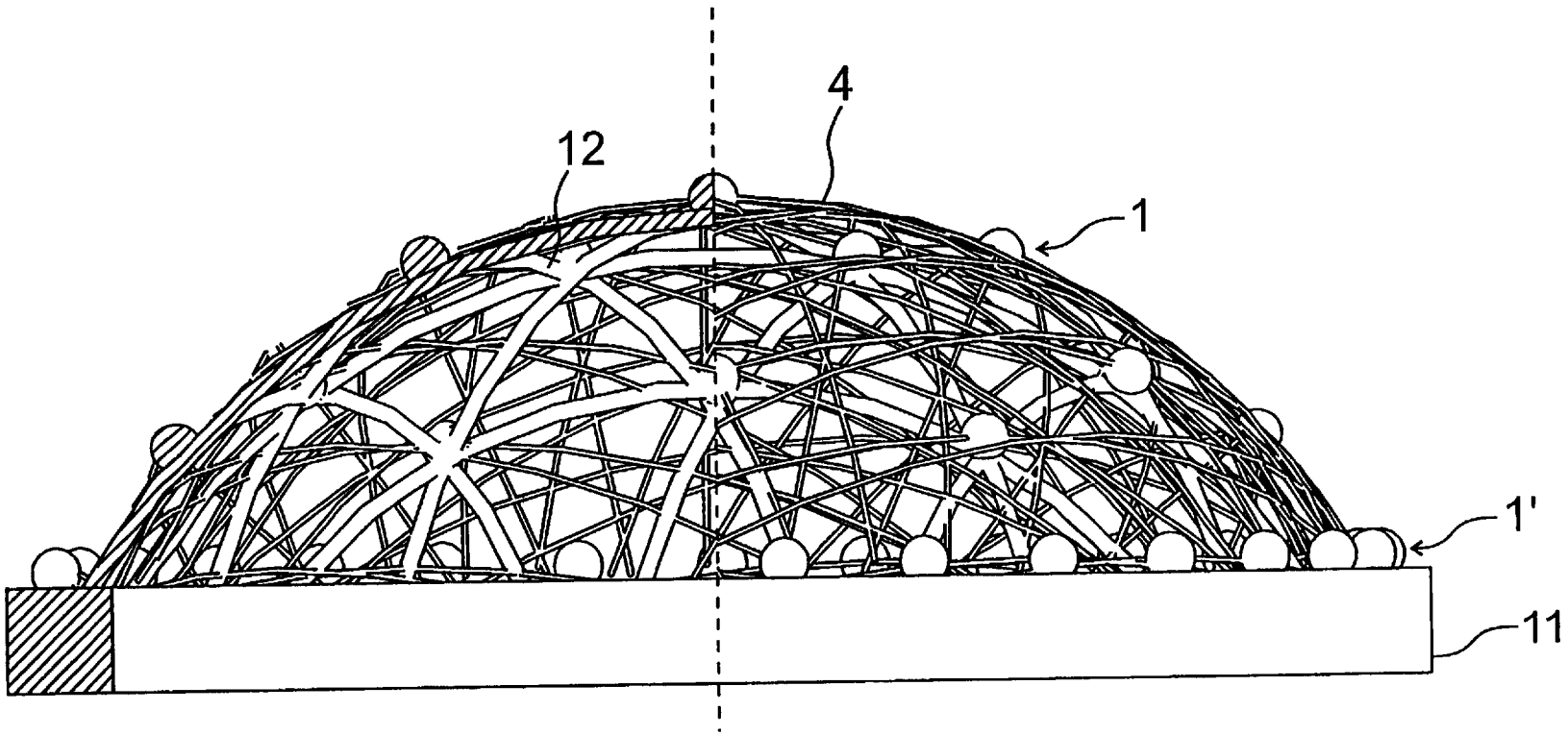
FIG. 16 is a front view of the embodiment manufactured by the method of FIGS. 12 to 15 partly in cross-section.

FIG. 16 shows a partial sectional front view of the mesh jewel made by the method shown in FIGS. 12 to 15. The nodes of the latticework of the mesh jewel are formed with node elements 1 arranged along the spherical surface as described above, which node elements 1 comprise the pin 2—arranged crosswise to the spherical surface—and the retaining element arranged on the outer end of the pin 2. In the depicted embodiment, the retaining elements have a ball shape fitted with a bore and they are pulled onto the ends of the pins, where they are fixed by welding or soldering. These retaining elements prevent the wire section parts adjoining the pins of the node elements 1 in displacing in the direction of the axis of pins 2, thereby allowing the creation of a rigid mesh. The latticework 12 serves as a firm support for the node elements 1, thereby increasing the rigidity of the mesh jewel.

The fixing node elements 1' comprise retaining elements arranged at an outer end of the fixing pins 2', which retaining elements are designed in the embodiment depicted as balls fitted with a bore. These retaining elements prevent the wire section parts passing by the fixing pins 2' in coming off the fixing pins 2'. It is not necessary to fit the fixing pins 2' in bores, but they may also be welded or soldered to the wall of the jewel body 11.

As already described above, the wire section 4 is arranged on the pins 2 of the node elements 1 arranged along the surface of the latticework 12 and on the pins 2' in a way that it is in contact without changing direction or is bent on the pins 2 and 2', repeatedly returns from different directions to and surrounds each pin 2 and 2'. The wire section parts in contact with pins 2 and 2' may be fixed by laser spot welding or soldering to the node elements 1 and 1'.

Figure 17:
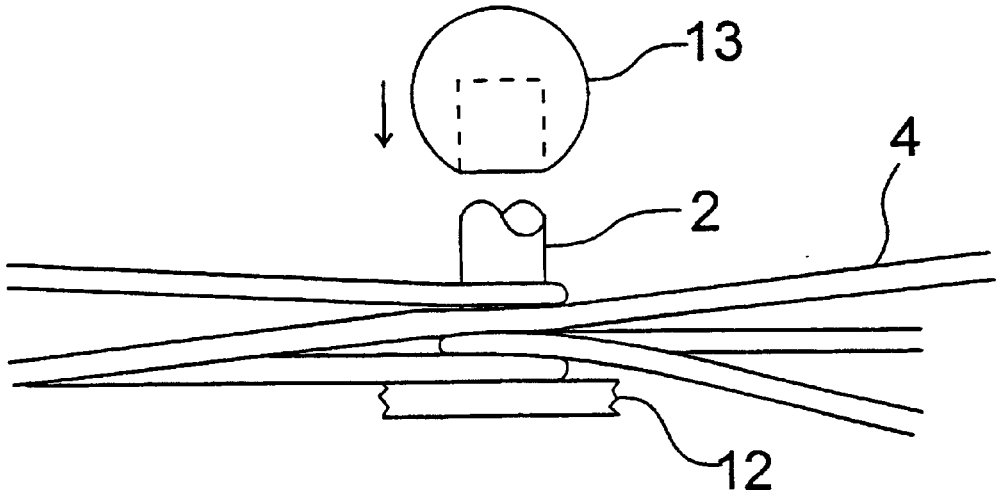
FIGS. 17 and 18 are front views depicting the manufacturing of the node elements of the mesh jewel as per FIG. 16.
Figure 18:
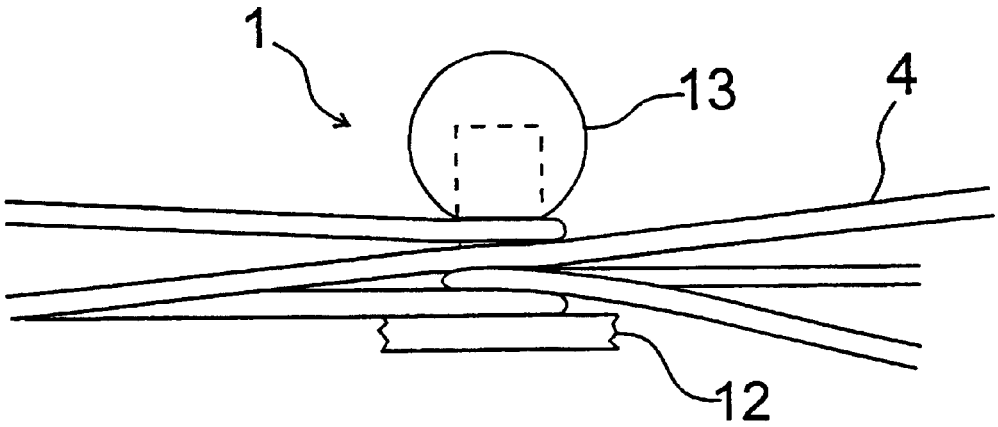

In FIGS. 17 and 18, the steps of manufacturing a node element 1 as per FIG. 16 can be seen. For forming the node element 1, first the cylindrical pin 2 is fixed by welding or soldering to the latticework 12. After arranging the wire sections 4 according to the description above, the protruding part of the pin 2 is cut to size and the free end of the pin 2 is closed by a ball shaped retaining element 13. In the ball shaped retaining element 13 a bore is formed, which is pulled onto the free end of the pin 2, and then the retaining element 13 is fixed by welding or soldering.

Figure 19:
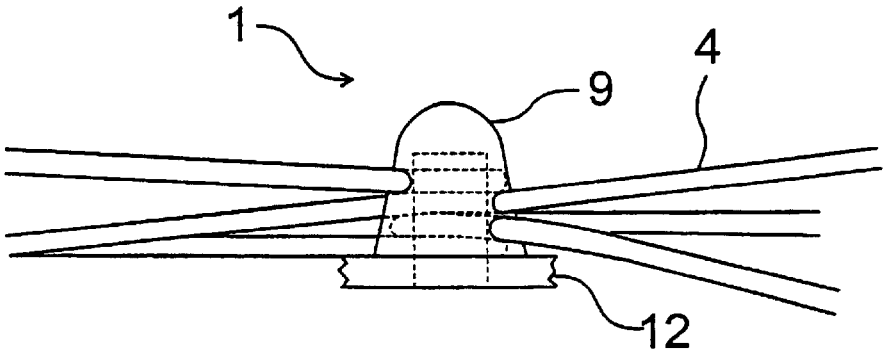
FIG. 19 is a front view of a node element made by soldering.

The node element 1 shown in FIG. 19 is closed by a soldered closing 9. When creating the closing 9, the solder runs into and between the wire section parts bent around the pin 2, and secures the wire section parts to the pin 2 and to the latticework 12. The melt generated in the course of soldering is then removed. Instead of the soldered closing 9, of course, a different joint may also be applied, for example a welded or bonded joint.

Figure 20:
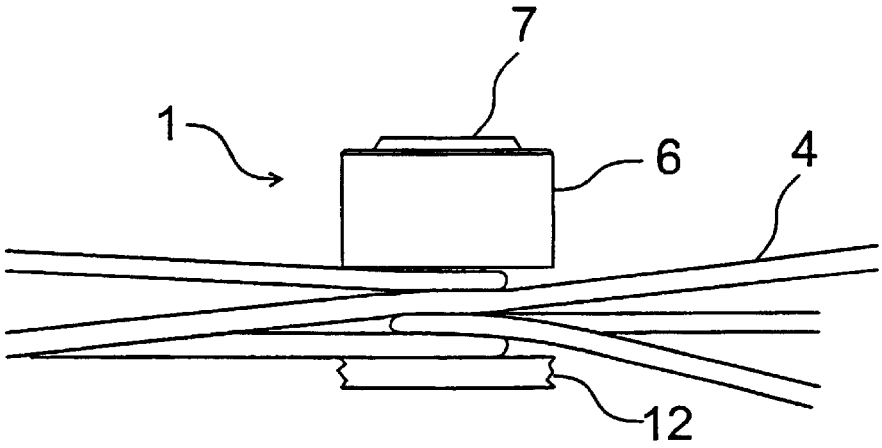
FIG. 20 is a front view of a node element with a setting.
Figure 21:
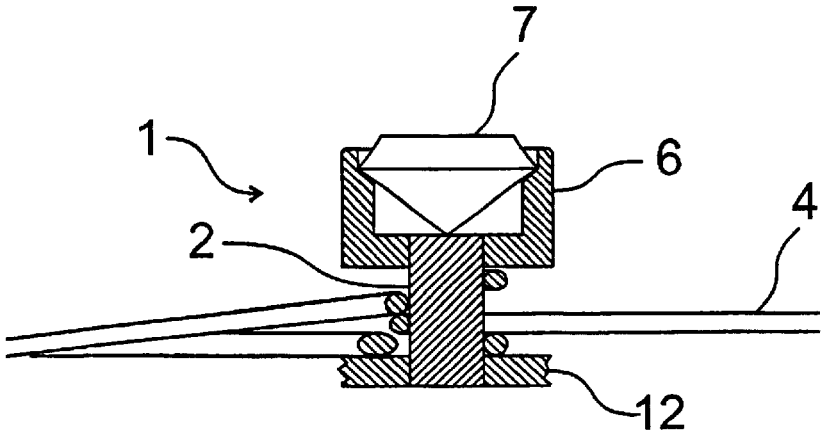
FIG. 21 is a cross sectional view of the node element as shown in FIG. 20.

In the case of another preferred embodiment shown in FIGS. 20 and 21, the free end of the pin 2 is closed with a retaining element 6 formed as a setting, wherein the latticework 12 and the setting surround the wire section parts adjoining the pin 2. The setting preferably receives a gem 7. The setting, which further improves the aesthetic appearance of the mesh jewel, is also fixed by welding or soldering to the pin 2.

The mesh jewel according to the invention is not limited to the embodiments described above, but may also be formed in a different way. It is possible for example to create a mesh jewel without a rigid jewel body, when the mesh preferably forms a closed body, for example a globe or a spatial heart shape. In the course of manufacturing this embodiment, the pins fitted with retaining elements are fixed to the surface of the shaping piece, the mesh is formed on the surface of the shaping piece, the free ends of the pins are closed and then the shaping piece is removed. In another embodiment, a latticework is formed on the surface of the shaping piece, pins are fixed to the lattice knots of the latticework, the shaping piece is removed, the at least one wire section is arranged as described above, and the free ends of the pins are closed. The casting step described above can be applied of course in the case of these embodiments as well. These embodiments are advantageous if the mesh jewel can be designed in a sufficiently rigid manner so that it does not suffer permanent deformation in the course of prolonged use, and if the mesh jewel is not subjected to any special mechanical load while being worn. Such a mesh jewel can be for example an ear-ring, a pendant etc.

At the ends of the pins, the retaining elements may not only be designed as a flange, ball or setting. For example the end of the pin can be melted, thereby forming a melt sphere at the end, and then the melt sphere is cooled. The retaining element so designed can sufficiently prevent the displacement of the wire section parts passing by the pin in the axial direction of the pin.

The mesh, the nodes and in the given case the jewel body may be made of the same precious metal, but if a varied colour effect is to be accomplished, different precious metals can be applied for each element. For example, a platinum wire can be soldered with pure gold. The material of the mesh jewel can be for example silver, white gold, green gold, red gold, pure gold, platinum, titanium or stainless steel.

What is claimed is:

1. A mesh jewel comprising a mesh formed by at least one metallic wire section arranged along a mesh surface, wherein the mesh comprises nodes located at adjoining wire section parts of said at least one wire section, and wherein at least some of the nodes are formed with a node element fixing the adjoining wire section parts together;

wherein the node elements comprise a pin arranged in cross direction to the mesh surface wherein the wire section parts adjoining the pin are tangential to or bent on the pin; and comprising means for retaining wherein ends of the pin are closed by the means for retaining so as to inhibit displacement of the adjoining wire section parts, in an axial direction of the pin, said means for retaining comprising a retaining element arranged at an end of the pin.

2. The mesh jewel according to claim 1, wherein the retaining elements are formed as flanges.

3. The mesh jewel according to claim 1, wherein the retaining elements are formed as balls having a bore.

4. The mesh jewel according to claim 1, further comprising wherein the retaining elements are formed as a setting holding a gem.

5. The mesh jewel according to claim 1, wherein the retaining elements are fixed to the end of the pin by soldering or welding.

6. The mesh jewel according to claim 1, wherein the retaining elements are formed integrally with the pin.

7. The mesh jewel according to claim 1, wherein the retaining elements comprise at least one of a soldered, welded, bonded and adhesive closing.

8. The mesh jewel according to claim 1, wherein the wire section parts adjoining the node elements are fixed to the node elements by soldering or welding.

9. The mesh jewel according to claim 1, further comprising a latticework formed along the mesh surface and defining lattice knots, wherein the at least one wire section is arranged along a surface of the latticework and is attached to the node elements fixed to the lattice knots of the latticework.

10. The mesh jewel according to claim 1, further comprising a rigid jewel body to which the mesh is attached.

11. The mesh jewel according to claim 10, wherein through holes are formed in the jewel body and the mesh is attached to the jewel body by looping the at least one wire section through the through holes.

12. The mesh jewel according to claim 10, wherein the mesh is attached to the jewel body by fixing the node elements to the jewel body with respective pins of the node elements.

13. The mesh jewel according to claim 10, further comprising distance rods and wherein the node elements are fixed to the jewel body y means of the distance rods.

14. The mesh jewel according to claim 10, further comprising a latticework secured to the jewel body and formed along the mesh surface and defining lattice knots, wherein the at least one wire section is arranged along a surface of the latticework and is attached to the node elements fixed to the lattice knots of the latticework.

15. The mesh jewel according to claim 1, wherein the mesh jewel is made of at least one of platinum, gold, silver, titanium and stainless steel.

* * * * *

UNITED STATES PATENT AND TRADEMARK OFFICE

CERTIFICATE OF CORRECTION

PATENT NO. : 6,766,659 B1
APPLICATION NO. : 10/030755
DATED : July 27, 2004
INVENTOR(S) : Miklós Varga It is certified that error appears in the above-identified patent and that said Letters Patent is hereby corrected as shown below:

Column 9,
Lines 17-18, delete “further comprising”.

Column 10,
Line 20, delete “y” and insert -- by --.

Signed and Sealed this

Twenty-seventh Day of June, 2006

JON W. DUDAS
*Director of the United States Patent and Trademark Office*